US007748867B2

(12) United States Patent
Brinkhoff et al.

(10) Patent No.: US 7,748,867 B2
(45) Date of Patent: Jul. 6, 2010

(54) DEFLECTION COMPONENT FOR A LUMINAIRE AND ASSOCIATED LUMINAIRE

(75) Inventors: Michael Brinkhoff, Kürten (DE); Hans-Jürgen Keck, Engelskirchen (DE); Rainer Kling, Dossenheim (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 161 days.

(21) Appl. No.: 11/886,913

(22) PCT Filed: Feb. 9, 2006

(86) PCT No.: PCT/DE2006/000222

§ 371 (c)(1), (2), (4) Date: Sep. 21, 2007

(87) PCT Pub. No.: WO2006/099827

PCT Pub. Date: Sep. 28, 2006

(65) Prior Publication Data

US 2009/0052188 A1 Feb. 26, 2009

(30) Foreign Application Priority Data

Mar. 21, 2005 (DE) ..... 10 2005 013 004

(51) Int. Cl.
*F21V 14/00* (2006.01)

(52) U.S. Cl. ..... 362/255; 362/256; 362/373; 313/13; 313/25; 313/634

(58) Field of Classification Search ..... 362/255, 362/256, 373; 313/13, 25, 634
See application file for complete search history.

(56) References Cited

U.S. PATENT DOCUMENTS

| | | | | |
|---|---|---|---|---|
| 5,075,586 | A * | 12/1991 | Jaeger et al. | 313/25 |
| 6,578,991 | B2 | 6/2003 | Beaumont | |
| 2001/0022727 | A1 | 9/2001 | Beaumont | |
| 2002/0017842 | A1 | 2/2002 | Narita | |

FOREIGN PATENT DOCUMENTS

| | | |
|---|---|---|
| DE | 8023886 | 1/1982 |
| DE | 38 29 156 | 3/1989 |
| EP | 0 391 283 | 10/1990 |
| EP | 0 451 647 | 3/1991 |
| EP | 1 178 510 | 2/2002 |
| EP | 1 471 563 | 10/2004 |

* cited by examiner

*Primary Examiner*—Sandra L O'Shea
*Assistant Examiner*—Meghan K Dunwiddie

(57) ABSTRACT

A deflection component for a luminaire is hollow and consists of two sections, of which a first section is parallel to the axis and a second section in contrast runs obliquely outwards.

8 Claims, 4 Drawing Sheets

DEFLECTION COMPONENT FOR A LUMINAIRE AND ASSOCIATED LUMINAIRE

TECHNICAL FIELD

The invention is based on a deflection component for a luminaire in accordance with the precharacterizing clause of claim 1. In particular, the deflection component here is one for a luminaire having metal-halide lamps with a pinch seal at two ends, primarily with a high power rating.

PRIOR ART

Such lamps are known in principle from EP 391 283 and EP 451 647. They are suitable for horizontal and vertical arrangement in a reflector.

A generic lamp is known from DE-A 38 29 156 which is installed horizontally in an associated luminaire.

DESCRIPTION OF THE INVENTION

The object of the present invention is to provide a deflection component in accordance with the precharacterizing clause of claim 1 which extends the life of the lamp in the luminaire even in the case of an unfavorable operating position.

This object is achieved by the characterizing features of claim 1. Particularly advantageous configurations can be found in the dependent claims.

A further object is that of providing a luminaire which comprises a deflection component and a reflector, the luminaire efficiency being as high as possible and at the same time the life being very long.

This object is achieved by the characterizing features of claim 3. Particularly advantageous configurations can be found in the dependent claims.

Specifically, the invention proposes a deflection component which is particularly suitable, in interaction with a high-pressure discharge lamp which has a metal halide filling, for vertical operation in a luminaire. This high-pressure discharge lamp has, as its features, an elongated discharge vessel, which defines an axial axis of symmetry and is sealed at two ends by seals, for example pinch seals or fuse seals, and surrounds a discharge volume, two electrodes opposing one another on the axis, and which contains an ionizable filling consisting of mercury, noble gas and metal halides, as well as power supply lines, which are connected to the electrodes via foils and which emerge at the ends of the discharge vessel. Typically, the lamp consumes a power of at least 600 W.

When they are installed in a luminaire, such lamps often have problems with their life as a result of uneven thermal loading. This applies in particular also in the case of an alignment close to the vertical, whereby the lamp is deflected from the vertical by no more than 45°.

Typically, until now it has therefore been attempted to provide forced cooling of the luminaire by means of a fan. The fan is fitted in the vicinity of the base. Its air flow reaches the lamp through slits in the housing. In terms of operation, it would be desirable for the end of the lamp which accommodates the cold spot to be heated, while the opposite, warmer end in the region of the second seal is cooled, with the result that best-possible isothermy is produced. However, the fan has precisely the opposite effect. The air principally flows past the first, lower seal and cools it instead of warming it. The air flow passes along the lamp and finally reaches the second, upper seal and cools it, but much less effectively than the first seal.

According to the invention, a deflection component is therefore provided which has a first section which is matched to the seal of the lamp and surrounds this first seal tightly, and a second section which protrudes at an angle outwards therefrom and is selected such that it firstly keeps the air flow away from the lower half of the discharge volume and deflects it only towards the upper half. At the same time, however, the length of the second section should be selected to be so short that it cannot result in shadowing of the discharge arc. The discharge vessel is the only bulb of the lamp and typically has an axially asymmetrical reflecting coating at a first end of the discharge volume for the axial installation in a reflector in a limited region, which includes the coldest point. Preferably, the coating is a metallic or nonmetallic layer, in particular consisting of zirconium oxide.

Typically, the coating extends so as to face the discharge as far as the tip of the electrode. In another embodiment, it is sufficient if it extends as far as the beginning of the head or merely on the seal. The head is often a ball or coil.

Typically, the coating extends facing away from the discharge towards the foil. The design of the coating finally depends on the details such as filling composition, desired color temperature and thermal loading in the luminaire, however.

In order to improve the thermal economy, some of the two pinch seals may be given a matt finish, as is known per se. In this case, the matt-finishing is preferably a coating which has been roughened by means of sandblasting or etching.

In particular metal halides from the group of elements consisting of Na, Tl, Cs and rare earth metals are suitable as the component of the filling since with them it is possible to easily set a color temperature of at least 4000 K.

Preferably, the lamp is operated in a luminaire in a vertical operating position, the coldest point (T) being positioned at the lowest point.

The high-pressure discharge lamp is designed to be particularly compact by virtue of the fact that the discharge vessel (2) is the only bulb.

The high-pressure discharge lamp may advantageously have electrodes with a shaft and head, in the case of which the shafts have a diameter of at most 1 mm.

A further aspect of the invention is directed at a luminaire having the high-pressure discharge lamp outlined at the outset and the deflection component. In this case, the luminaire has a concave, rotationally symmetrical reflector having an optical axis, which corresponds with the lamp axis, an apex, which is open in the region where the optical axis intersects the reflector, and contains a holding apparatus for the first end of the discharge vessel, the luminaire having the deflection component which acts as a cooling apparatus for the lamp in the region of this first end.

In this case, an advantageous embodiment is that the cooling apparatus is a cooling plate which is arranged substantially axially parallel, that end of the cooling plate which faces the discharge protruding outwards at an angle approximately at the height of the end of the discharge vessel. Particularly suitable is an angle of 45±20° and a length of the second section which is dimensioned such that the upper edge of the deflection component ends approximately at the height of the electrode head.

In particular, in addition a further deflection component can be associated with the second power supply line. Advantageously, this second deflection component does not rest on the second pinch seal. It is more effective if it at least has a gap of 5 mm from the second seal. Advantageously, an efficient effect is realized with the second deflection component by virtue of the fact that it comprises at least one metal sheet, which is arranged transversely with respect to the axis of the reflector. This high degree of efficiency is associated with the fact that the diameter of the reflector in the region of the second deflection component is already much wider than in the vicinity of the apex.

Advantageously, the second power supply line is connected to a solid return line.

In particular, the luminaire is designed for general lighting purposes. Correspondingly, it is designed for a life of at least 2500 hours. In this case, a particularly high degree of compactness is in particular achieved by virtue of the fact that the two electrical connections are arranged in the region of the apex.

Particularly advantageously, the return line is guided closely past the discharge vessel back to the apex in order to keep shadowing to a minimum. A particularly compact luminaire is realized by the return line ending in the holding apparatus.

The lamp according to the invention achieves a life of at least 2500 hours even during vertical operation in a compact luminaire, and, given an optimum design of the luminaire with suitable cooling apparatuses, the life is at least 4500 hours. Vertical operation allows a particularly high luminous efficiency.

For applications in rooms or at dusk, the light color neutral white and, for very stringent requirements as regards the color rendition, neutral white deluxe NDL is very suitable with a color temperature of approximately 4100 to 4400 K and an Ra of at least 84.

The lamp according to the invention is also suitable for indirect lighting, for example with reflector spotlight systems in which a high luminous flux is required.

It is suitable for a novel modular luminaire concept in which a given lamp can be matched to different specially designed luminaires by the coating on the lamp being optimized and by possibly corresponding deflection components being provided in the luminaire. The operating position, the light color and power of the lamp can therefore be matched ideally to the boundary conditions of the luminaire.

The cooling apparatuses are designed such that they allow a maximum temperature drop between the upper and lower foil, in particular their ends remote from the discharge, of 150° C. during operation. Furthermore, the cooling apparatuses are designed such that they guarantee a maximum temperature of the lamp during operation of at most 390° C.

Light-active metal halide fillings often contain sodium as a constituent. High luminous efficiencies and the desired color components can therefore be achieved. On the other hand, a high sodium content results in increased corrosion of the discharge vessel, although it is usually produced from quartz glass. The content of Na is therefore often relatively low and in particular is supplemented or replaced entirely or partially by thallium, cesium or other rare earth metals such as Dy, Hm or Tm.

Preferably, in the case of lower-wattage lamps, in particular 600 to 1600 W, the ends of the discharge vessel are coated up to the tip of the electrode; this is primarily the case for neutral white fillings with a color temperature of from 4000 to 4800 K. Overall, the temperature of the cold spot, but also the foil end temperature and the wall loading is thereby increased, with the result that they reach optimum values.

Preferably, in the case of higher-wattage lamps, in particular 1700 to 2000 W or more, fillings with a low content of Na or no content of Na at all are preferably used. Since this lamp is subjected to markedly greater thermal loads, matt-finishing of the pinch seals is in this case particularly recommendable. This makes it possible to limit the temperature of the lamp to a maximum of 350° C. even in a narrow luminaire. This applies both to a horizontal and a vertical operating position.

Particularly critical is the temperature at the foil end. The matt-finishing should therefore in each case include the region of the outer foil end. Advantageously, it extends up to the end of the pinch seal. On the inside, towards the discharge, it can extend at least to the center of the foil, under certain circumstances also markedly beyond this, for example as far as the inner end of the foil.

Typical gaps between the electrode tips are 25 to 35 mm for particularly compact luminaires, but also gaps of up to 100 mm or more are possible.

In such compact luminaires, the lamp and the reflector form a single thermal system, which needs to meet the requirements of the lamp, in particular a maximum temperature of 390° C. For this purpose, at least one thermal cooling apparatus is fitted in the luminaire in such a way that it brings about as little shadowing as possible. This requires an arrangement of the cooling apparatuses which is as close to the axis as possible.

An efficient means for thermal influencing is an open apex of the reflector, so that cool air can enter the reflector from below. This air can then flow past the lower pinch seal. In particular, the cooling apparatus is realized by a fan or by openings in the apex with covering. Different admittance values can therefore be set, depending on the specific configuration of the reflector.

An increase in the admittance value is in this case achieved by a deflection component, which is fitted directly to the lower first pinch seal. It comprises spring sheet metal and can be clipped or pushed onto the pinch seal and provided with a tongue acting as a barb. It can then be fitted onto the lamp in a simple manner before said lamp is installed in the luminaire. This is, for example, a cooling plate, which runs substantially axially parallel and ends at the height of the pinch seal. The cooling effect is particularly effective owing to the fact that the second section of the cooling plate protrudes from the axis at the height of the pinch seal.

Alternatively, the deflection component may be a separate part of the luminaire which is equipped with a holding apparatus and surrounds the first seal at a slight distance.

Additional cooling can be provided at the second end of the discharge vessel. However, it is surprisingly not so much the pinch seal which is at risk here, but that end of the pinch seal from which the power supply line emerges towards the outside. Here, undesirable cracks or capillaries are formed which may lead to a lack of sealtightness. In order to avoid this, the additional cooling is provided above the second pinch seal, for example at a distance of approximately 5 to 15 mm. Particularly advantageous is a cooling plate with deflecting ribs positioned transversely with respect to the axis.

The heat dissipation is advantageously further improved by virtue of the fact that the return line is designed to be solid, with the result that it can itself act as a holder. A rod with a diameter of at least 5 mm is suitable for this purpose. It should consist in particular of corrosion-resistant molybdenum.

FIGURES

The invention will be explained in more detail below with reference to a plurality of exemplary embodiments. In the figures:

FIG. 1 shows a metal-halide lamp in a side view;

FIG. 2 shows an exemplary embodiment of a deflection component;

FIG. 3 shows an exemplary embodiment of a luminaire in a side view;

FIG. 4 shows a further exemplary embodiment of a luminaire in a side view.

Figure 1:
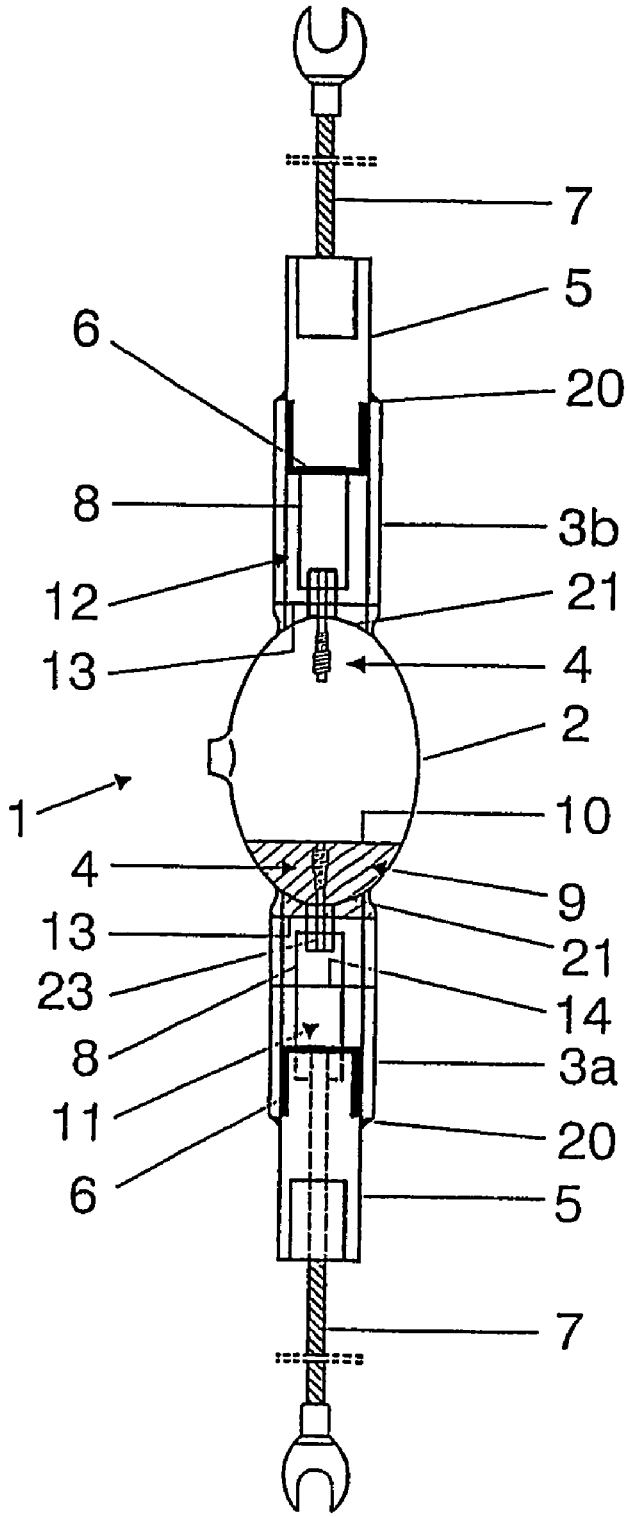
FIG. 1 illustrates schematically a 2000 W high-pressure discharge lamp 1 without an outer bulb having a length of approximately 190 mm, as is described in more detail, for example, in U.S. Pat. No. 5,142,195. It is intended for use in reflectors, it being arranged axially with respect to the reflector axis.

The discharge vessel 2 consisting of quartz glass defines a longitudinal axis X and is in the form of a barrel body, whose generatrix is the arc of a circle. The discharge volume is approximately 20 $cm^3$. The rod-shaped tungsten electrodes 4 with a coil pushed on as the head are axially aligned in pinch seals 3 at both ends of the discharge vessel. The electrodes 4 are fixed to foils 8 in each case in the pinch seal 3*a*, 3*b*, to which external power supply lines 7 are attached. A ceramic base 5 is fixed with cement 6 to that end 20 of the pinch seal 3 which is remote from the discharge. The discharge vessel 2 contains a filling consisting of a noble gas, mercury and metal halides. The first end of the discharge volume is provided with a heat accumulation dome 9 consisting of zirconium oxide.

The dome 9 extends around the pinch-seal edge 21, precisely in such a way that its end 10 facing the discharge ends with the tip of the electrode. The head of the electrode in this case also comprises a coil pushed onto the tip. That end 13 of the coating which is remote from the discharge has a gap of approximately 2 mm from the pinch-seal edge.

The lower first pinch seal 3*a* is additionally provided with a matt-finish 11, which extends from the outer end of the pinch seal 20 as far as beyond the center of the foil as far as approximately 70% of the foil length. The inner end of the matt finish is denoted by 14.

The upper second pinch seal 3*b* is also provided with a matt-finish 12. However, this extends from the outer end of the pinch seal 20 as far as beyond the inner end of the foil as far as close to the pinch-seal edge. The inner end of the matt finish is denoted by 19.

In this exemplary embodiment, the light color daylight is realized by the filling. In this case, the upper pinch seal is limited to a maximum temperature of 390° C. by the matt finish alone. The lower pinch seal has a shorter matt finish (axial length is 35 mm) and the coating 9. Together, these increase the temperature of the cold spot, which is located in the vicinity of the lower pinch-seal edge 21, as far as possible. The matt finish and the coating together fix the temperature distribution at the shaft 23 of the electrode. An optimum temperature distribution which is as even as possible delays the corrosion of the shaft by means of halogens, which are a constituent of the filling. In this case, it has proven advantageous to use iodine on its own or both bromine and iodine as halogens, wherein a ratio of bromine to iodine of at most 1.45 is favorable. In particular, this ratio is approximately 0.6 to 1.2. As a result, erosion on the shaft is minimized and nevertheless good maintenance of the luminous flux (85% after an operating time of 2500 hours) is achieved. The uniform temperature distribution makes it possible to use thinner pins as the shaft (0.5 to 1 mm in diameter), which can be embedded more tightly in the quartz glass during pinch-sealing and reduce the volume of the capillaries. Such a thin shaft needs to be compatible with the design of the halogen cycle process, in particular by careful selection of the bromine to iodine ratio as explained above. Such thin shafts also restrict the dissipation of heat, with the result that an additional accumulation of heat arises at this point which prevents the occurrence of metal halide deposits. As a result, the reflector coating is reduced to a small axial length, which reduces shadowing. The maximum extent is approximately as far as the electrode tip, but it preferably reaches at most to the beginning of the head of the electrode. Under certain circumstances, the coating can even be dispensed with entirely if the shaft can be dimensioned to be sufficiently thin. A relatively narrow coating also reduces the wall loading brought about thereby. Desirable is a value for the wall loading of at least 50 and at most 70 $W/cm^2$.

Figure 2:
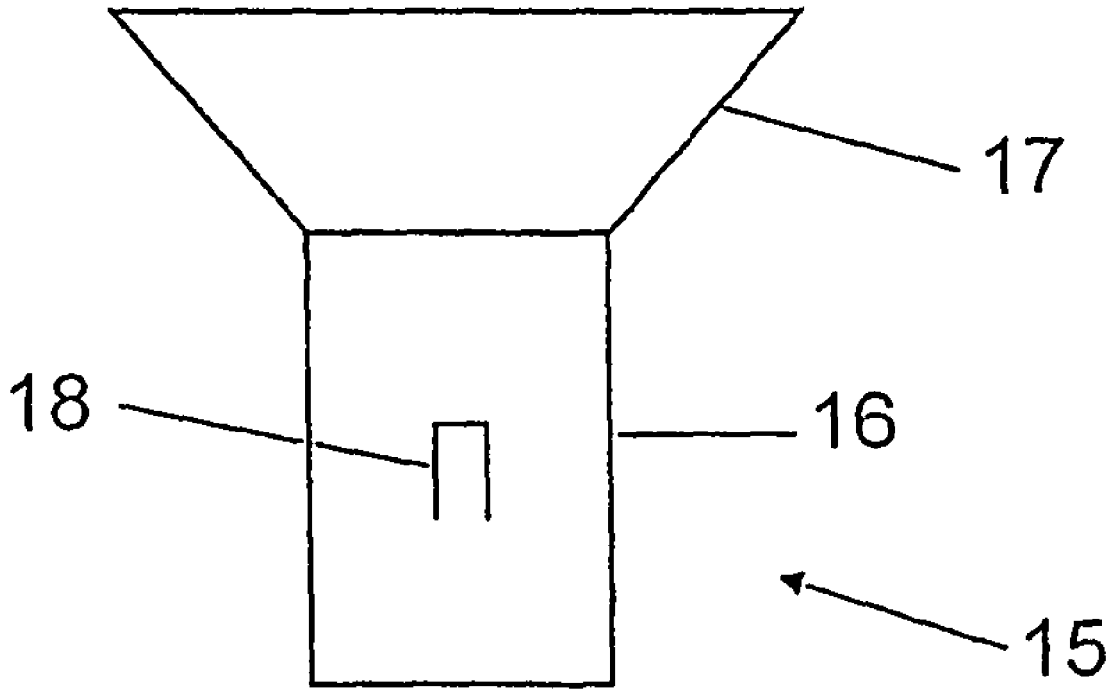

FIG. 2 shows an exemplary embodiment of the deflection component 15. It is hollow on the inside. It comprises an approximately square first section 16, which runs axially parallel to the axis of the lamp, a second section 17, which is widened in the form of a funnel and reaches approximately as far as the height of the electrode head, resting on the upper end of said first section 16. The angle of the inclination is approximately 45°. Tongues 18 (only one is visible) are stamped out on the two broad sides of the first section, which tongues 18 are anchored on elevations on the pinch seal of the lamp.

Figure 3:
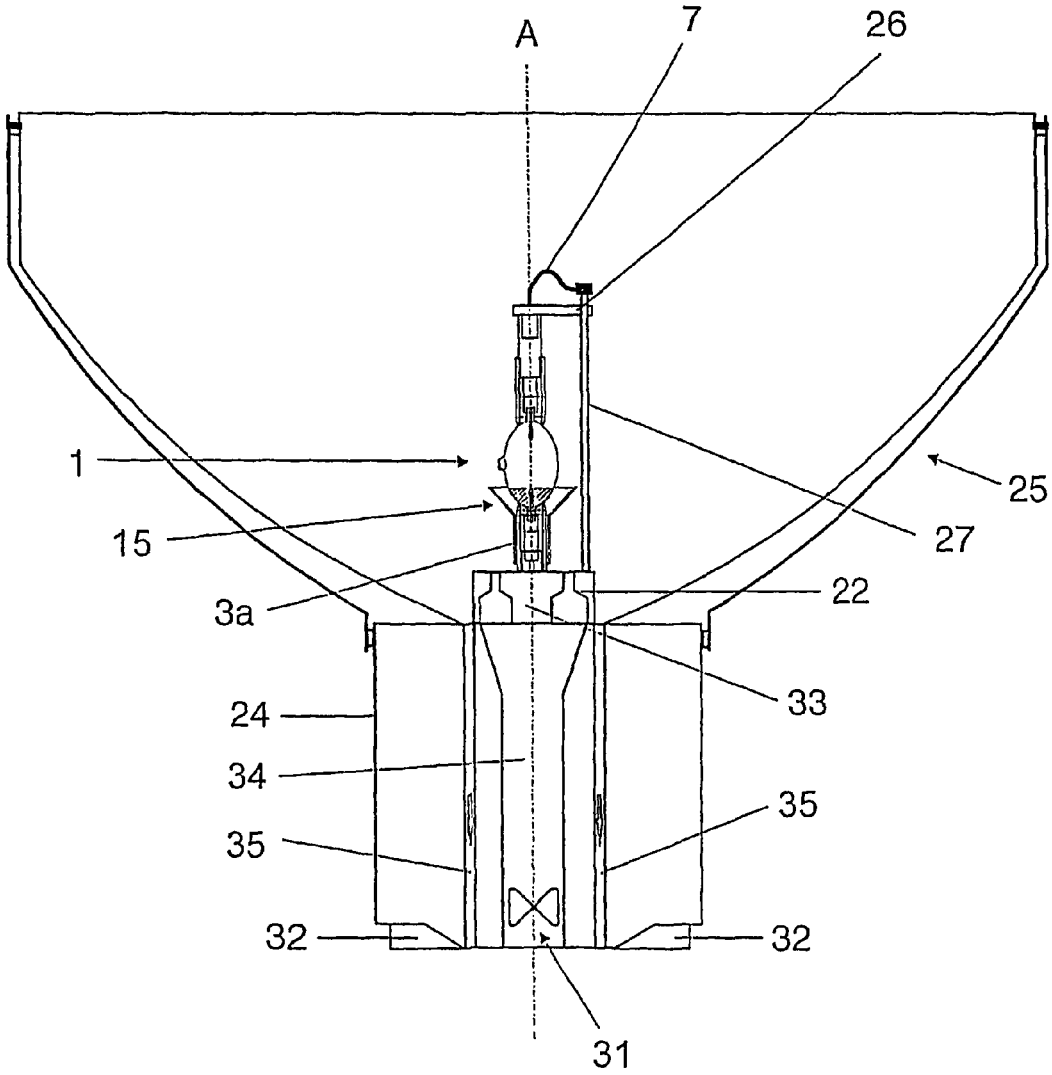

FIG. 3 shows a side view of a luminaire, which substantially comprises the lamp 1 and the reflector 25 as well as a base part 24. Further housing parts which are not essential have been omitted. The lamp 1 is held in the apex of the reflector by a holding apparatus 33, which surrounds the lower end of the first pinch seal and rests on the base part 24. In addition, the holding apparatus accommodates the return line 27, which holds the upper pinch seal via a collar 26. The return line 27 is connected to the upper outer power supply line 7, which is in the form of a braided wire. The base part 24 also has contacts 32.

In addition, the luminaire comprises a cooling apparatus at the lower end by openings 34 in the base allowing the air flow originating from a fan 31 to circulate, which air flow is deflected by the deflection part 15. Further slots 35 allow the air flow to emerge again at the base-side end. The deflection part 15 is fixed on the lower pinch seal 3*a*, in particular by means of the tongues 18 (not visible).

Figure 4:
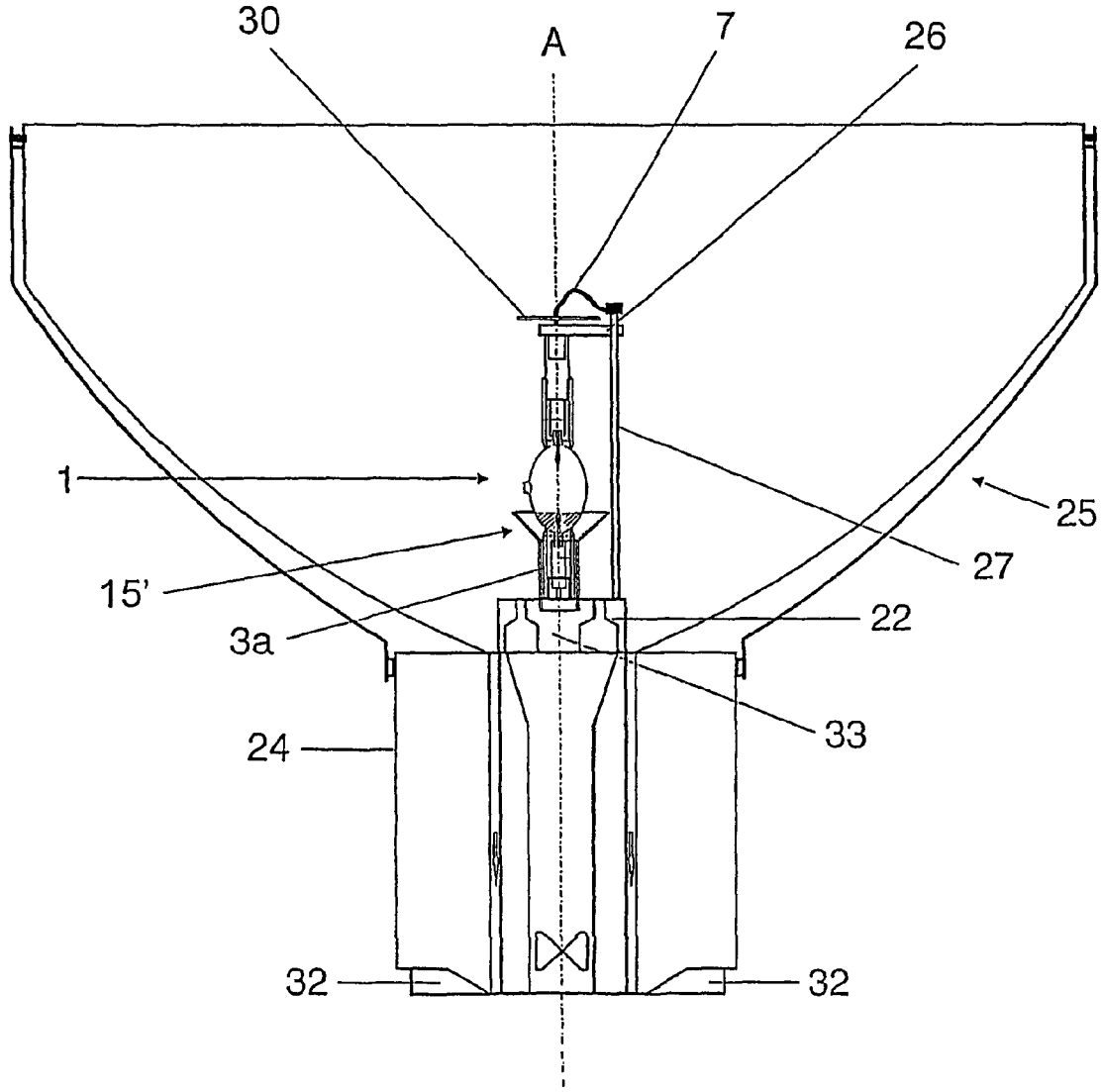

In a particularly preferred embodiment (FIG. 4), firstly the power supply line 7 is so solid that it bears a circular collar 30, which acts as an additional cooling plate. In this case, the collar acts as an active heat dissipation means, which is fitted to the power supply line 7 approximately 10 mm behind the end of the upper second pinch seal. One alternative is a cooling plate arrangement comprising three plates, which are positioned one behind the other transversely with respect to the axis of the reflector.

In this case it is not the deflection component 15' which is fixed to the pinch seal 3*a*, but a separate part, which is fixed in the receptacle 22, and is slightly spaced apart from the pinch seal 3*a*. In general, the deflection component is manufactured from spring sheet metal.

The invention claimed is:

1. A deflection component for use in a luminaire, which defines an axis, together with a high-pressure discharge lamp, characterized in that the deflection component:

is manufactured from sprung sheet metal and is hollow, and comprises two sections, the first section comprising a hollow-cylindrical part, which is aligned axially parallel and at least one tongue is stamped out in the first section, the tongue being a holding means, while a second section comprises a funnel-shaped part, adjoins said first section, and is inclined outwards at an angle with respect to the axis.

2. A luminaire, which defines a longitudinal axis, having a high-pressure discharge lamp, in which a discharge vessel is the only bulb, the discharge vessel being aligned axially and having two seals, the luminaire having a housing with a concave, rotationally symmetrical reflector, and being equipped with an apex opening at the end of the reflector, a holding apparatus for the first seal of the discharge vessel being fitted in the region of said reflector, the luminaire also having a deflection component in accordance with claim 1, wherein the length of the second section and the angle of the second section are configured such that shadowing of a discharge arc of the high-pressure discharge lamp is prevented.

3. A luminaire, which defines a longitudinal axis, having a high-pressure discharge lamp, in which a discharge vessel is the only bulb, the discharge vessel being aligned axially and having two seals, the luminaire having a housing with a concave, rotationally symmetrical reflector, and being equipped with an apex opening at the end of the reflector, a holding apparatus for the first seal of the discharge vessel being fitted in the region of said reflector, the luminaire also having a deflection component in accordance with claim 1.

4. The luminaire as claimed in claim 2, characterized in that the deflection component is fixed directly on the first seal.

5. The luminaire as claimed in claim 2, characterized in that the deflection component is a separate part, which is connected to a housing part, in particular to the holding apparatus.

6. The luminaire as claimed in claim 2, characterized in that the luminaire has an additional cooling apparatus in the region of the second seal.

7. The luminaire as claimed in claim 6, characterized in that the cooling apparatus comprises at least one cooling plate, which is arranged transversely with respect to the axis of the luminaire.

8. The luminaire as claimed in claim 2, wherein the length of the second section and the angle of the second section are configured such that the deflection component deflects air flow towards substantially the upper half of the discharge vessel.

* * * * *